US006773186B1

(12) United States Patent
Shih

(10) Patent No.: US 6,773,186 B1
(45) Date of Patent: Aug. 10, 2004

(54) COSMETIC CONTAINER

(75) Inventor: Yu-Ching Shih, Yung Kung (TW)

(73) Assignee: Hawthorn Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 10/725,033

(22) Filed: Dec. 2, 2003

(51) Int. Cl.[7] ..... A46B 11/100
(52) U.S. Cl. ..... 401/129; 401/127
(58) Field of Search ..... 401/116, 126–130

(56) References Cited

U.S. PATENT DOCUMENTS 4,498,490 A * 2/1985 Seidler ..... 401/127
4,984,920 A * 1/1991 O'Neill ..... 401/127
5,121,763 A * 6/1992 Kingsford ..... 401/129
6,082,918 A * 7/2000 Gueret ..... 401/129

* cited by examiner

*Primary Examiner*—Tuan N. Nguyen
(74) *Attorney, Agent, or Firm*—Rosenberg Klein & Lee

(57) ABSTRACT

A cosmetic container includes a containing part, a cover, and a brush, which is inseparably screwed into a step-shaped portion of the cover at an upper portion; the containing part has an inner lid securely disposed over the upper opening, which lid has a non-circular hole fitting a bristles-formed lower portion of the brush; the upper portion of the brush has a stopping rim around a lower end; the cosmetic container can be closed by means of screwing the cover onto the containing part with the brush lower portion being passed through the inner lid, and with the stopping rim being pressed against the lid; thus, when the cover is being screwed on the containing part, it will be displaced relative to the brush while the brush can be removed from the containing part after the cover has been screwed off the containing part.

5 Claims, 6 Drawing Sheets

COSMETIC CONTAINER

BACKGROUND OF THE INVENTION

1. Field of the Invention

The present invention relates to a cosmetic container, more particularly one, which is structured in such a manner as to be convenient to use.

2. Brief Description of the Prior Art

Cosmetics are among the important beauty products in female market. Therefore, a wide variety of containers have been developed for cosmetics, and it is a constant effort of the cosmetic industry to develop novel containers for attracting the consumers.

Referring to FIGS. 5 and 6, a conventional cosmetic container includes a containing part 4, a brush 6, and a cover 5. The containing part 4 is provided for containing cosmetics therein, and has an opening on an upper end, and screw threads 41 on an outer side of the upper end. An inner lid 42, which is formed with a non-circular hole 421 on the middle, is securely disposed on the upper opening of the containing part 4. The brush 6 has a brush portion 61, and a handle portion 62, which is connected with the brush portion 61. In addition, the handle portion 62 fits the non-circular hole 421 of the inner lid 42 such that when it is inserted in the hole 421, the space between it and the edge of the hole 421 is as small as possible while it can be easily moved through the hole 41. The cover 5 is formed with screw threads 51 on an inner side so that it can be firmly screwed onto the threaded upper end of the containing part 4 to cover the containing part 4.

When the cosmetic container is not in use, the brush 6 is inserted in the inner lid 42 with the brush portion 61 being held in the containing part 4, and the cover 5 connected with the containing part 4 to protect the cosmetic and prevent the brush 6 from falling off.

However, the cosmetic container is found to have disadvantages as followings:

1. To make up with the cosmetic and the brush 6, one has to first open, and put aside, the cover 5, and then take the brush 6. In other words, before one makes up with the brush 6 and the cosmetic in the containing part 4, she has to move her hands onto the container twice, and has to put the cover 5 in a proper place lest the cover 5 get lost. Therefore, the cosmetic container is not convenient to use, and the cover 5 is prone to get lost.
2. The handle portion 62 of the brush 6 has to be at least slightly smaller than the non-circular hole 421 of the inner lid 42 otherwise the handle portion 62 can't be easily inserted in, or removed from, the non-circular hole 421. Therefore, the brush 6 is not firmly held in position, and is likely to shake when the container is being carried around or transported. Consequently, the cosmetic is prone to, especially when it in the containing part 4 is in the form of powder, pass into the space between the cover 5 and the inner lid 42, and spread over the handle portion 62 and the inner side of the cover 5 to cause inconvenience to the user.

SUMMARY OF THE INVENTION

It is a main object of the present invention to provide a cosmetic container to overcome the above disadvantages.

The cosmetic container of the present invention includes a containing part, a cover, and a brush. The brush has a bristles-formed lower portion, a threaded upper portion, and a stopping rim around the lower end of the threaded upper portion. The brush is inseparably screwed into a step-shaped portion of the cover at the upper portion. The containing part has an inner lid securely disposed over the upper opening, which lid has a non-circular hole fitting the bristles-formed lower portion of the brush. Thus, the cosmetic container can be closed by means of screwing the cover onto the containing part with the bristles-formed lower portion being held in the inner lid, and with the stopping rim being pressed against the lid to prevent cosmetic in the containing part from passing into the cover. The brush can be removed from the containing part after the cover has been screwed off the containing part.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
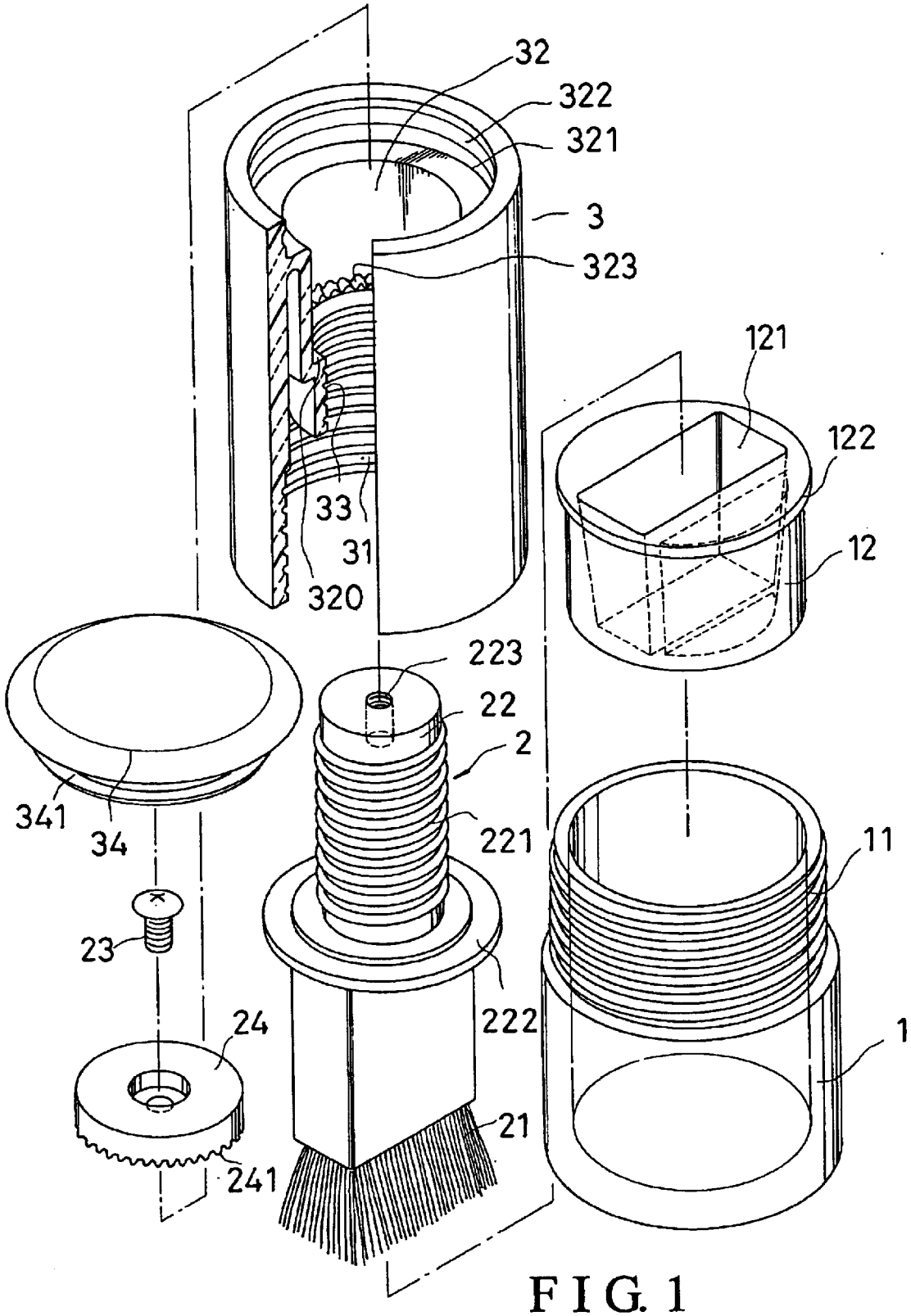
FIG. 1 is an exploded perspective view of the cosmetic container according to the present invention.
Figure 2:
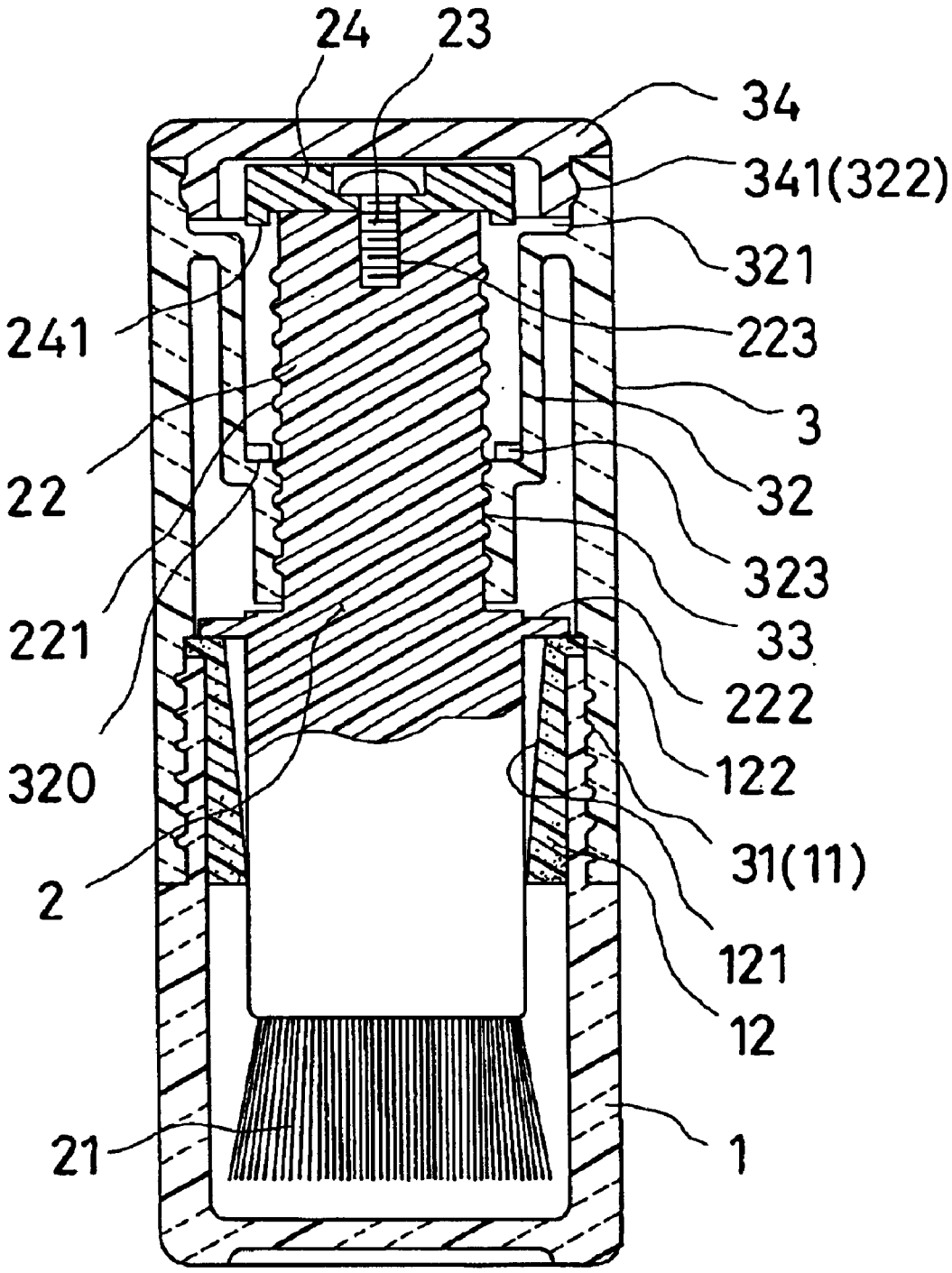
FIG. 2 is a vertical section of the cosmetic container according to the present invention.
Figure 3:
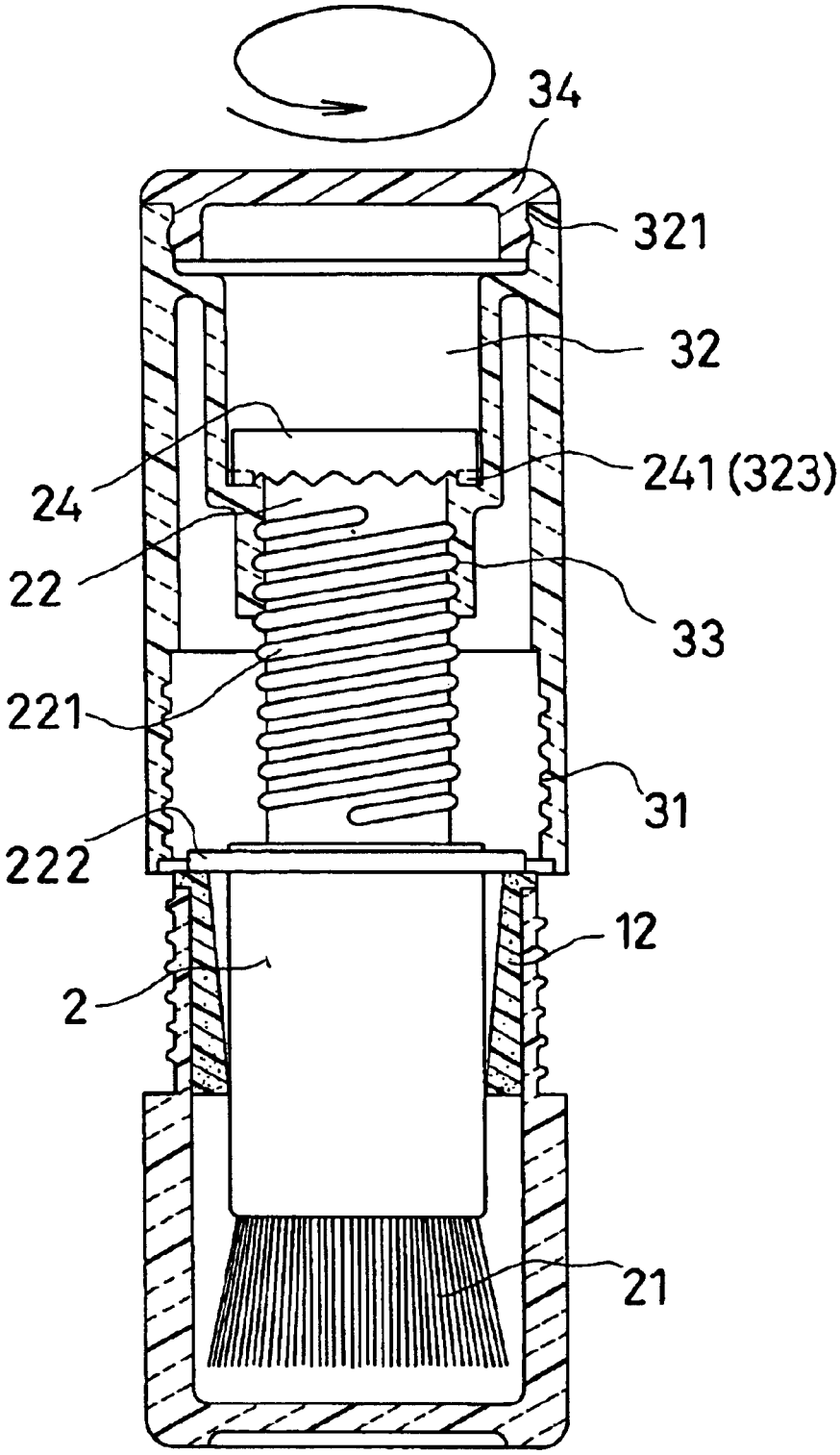
FIG. 3 is a view of the cosmetic container of the present invention with the cover being screwed off the containing part.

Referring to FIGS. 1 to 3, a preferred embodiment of a cosmetic container in the present invention includes a containing part 1, a brush 2, and a covering part 3.

The containing part 1 has an upper opening, and screw threads 11 on an outer side of an upper end portion thereof. An inner lid 12 is disposed over the upper opening, and securely connected to the containing part 1; the inner lid 12 is formed with a non-circular hole 121, and an annular edge 122 on an upper portion thereof, which annular edge 122 is supported on the top of the containing part 1.

The brush 2 has a brush portion 21, and an extension portion 22 extending from an upper end of the brush portion 21. The extension portion 22 has screw threads 221 around it, a fitting screw hole 223 on an upper end, and a stopping rim 222 around a lower end thereof. A detained block 24 is securely disposed on the upper end of the extension portion 22 of the brush 2 by means of a threaded fixing element 23, e.g. a bolt, which is inserted through the block 24 and into the fitting hole 223. The brush portion 21 is formed with such a shape that it fits the non-circular hole 121 of the inner lid 12 such that when it is inserted in the hole 121, the space between it and the edge of the hole 121 is very small, and it can be smoothly moved through the hole 121.

The covering part 3 is screwed onto the brush 2 such that it is displaceable relative to the brush 2, but can't separate from the same. The covering part 3 has first and second connecting portions 31, and 32 on a lower section of an inner side, and an upper section of the inner side respectively. The first connecting portion 31 is formed with screw threads. The second connecting portion 32 is formed with a step shape such that an upwards-facing annular side 320 is provided, and such that a lower section thereof has a smaller inner diameter than an upper section thereof and the first connecting portion 31; the upper section of the step-shaped portion 32 has a larger diameter than the detained block 24 while the lower section of the step-shaped portion 32 has a smaller diameter than the detained block 24. In addition, the lower section of the second connecting portion 32 has screw threads 33 thereon for connection with the threaded portion 22 of the brush 2. The covering part 3 is further formed with an annular holding portion 321 on the upper end, and an annular trench 322 on an inner side of the holding portion 321. The covering part 3 is provided with a cap 34, which is securely connected with the annular holding portion 321 with an annular protrusion 341 being fitted in the annular trench 322.

In addition, the detained block 24 has a larger diameter than the lower section of the second connecting portion 32 of the covering part 3, but has a smaller diameter than the upper section of the second connecting portion 32.

In assembly, first the brush 2 is screwed into the threaded lower section of the second connecting portion 32 of the covering part 3 at the threaded extension portion 22, and the detained block 24 is secured to the top of the extension portion 22; thus, the brush 2 can't separate from the covering part 3. Then, the cap 34 is fitted to the covering part 3.

Thus, the containing part 1 can be covered with the covering par 3 with the brush portion 21 of the brush 2 being inserted through the non-circular hole 121 of the inner lid 12, with the covering part 3 being screwed onto the threaded upper end of the containing part 1 at the first threaded connecting portion 31, and with the stopping rim 222 of the brush 2 being pressed against the upper portion of the inner lid 12. Consequently, the brush 2 is stably held in position by the covering part 3, and can prevent cosmetic in the containing part 1 from passing into the covering part 3, especially when the cosmetic is in the form of powder.

Figure 4:
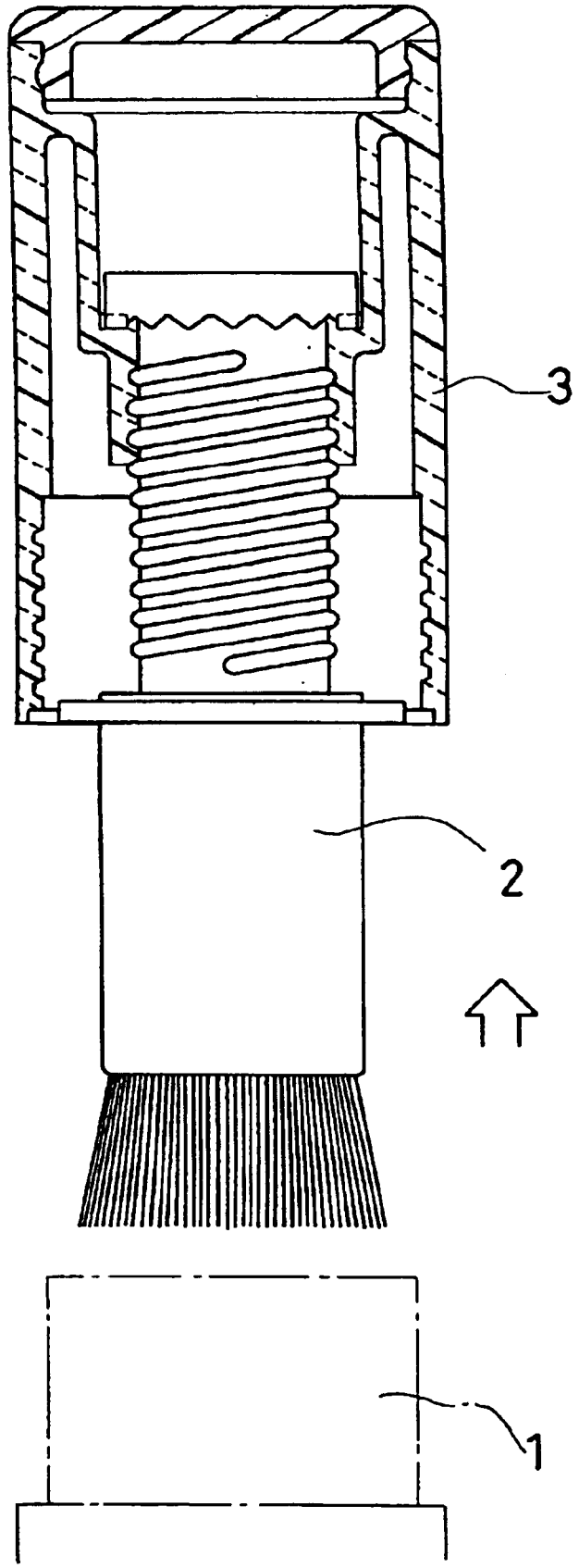
FIG. 4 is a view of the cosmetic container of the present invention with the cover being moved away from the containing part.
Figure 5:
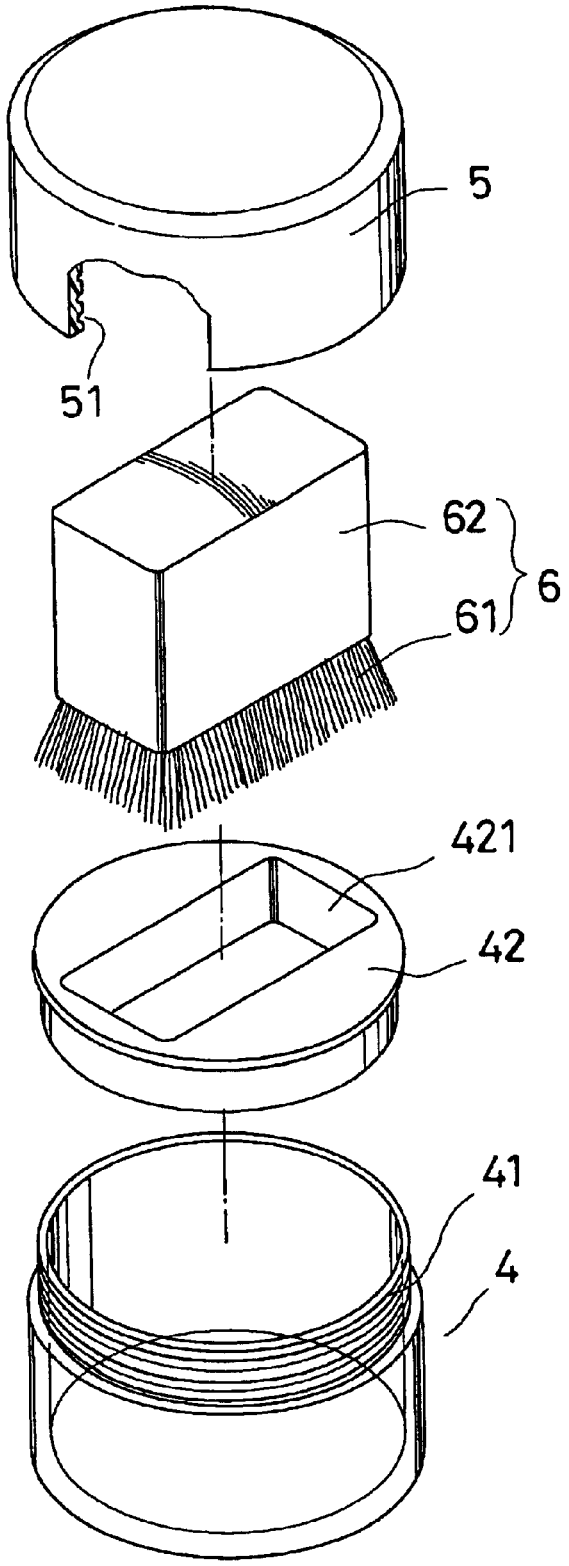
F I G. 5 (PRIOR ART)
FIG. 5 is an exploded perspective view of the conventional cosmetic container as described in the Background.
Figure 6:
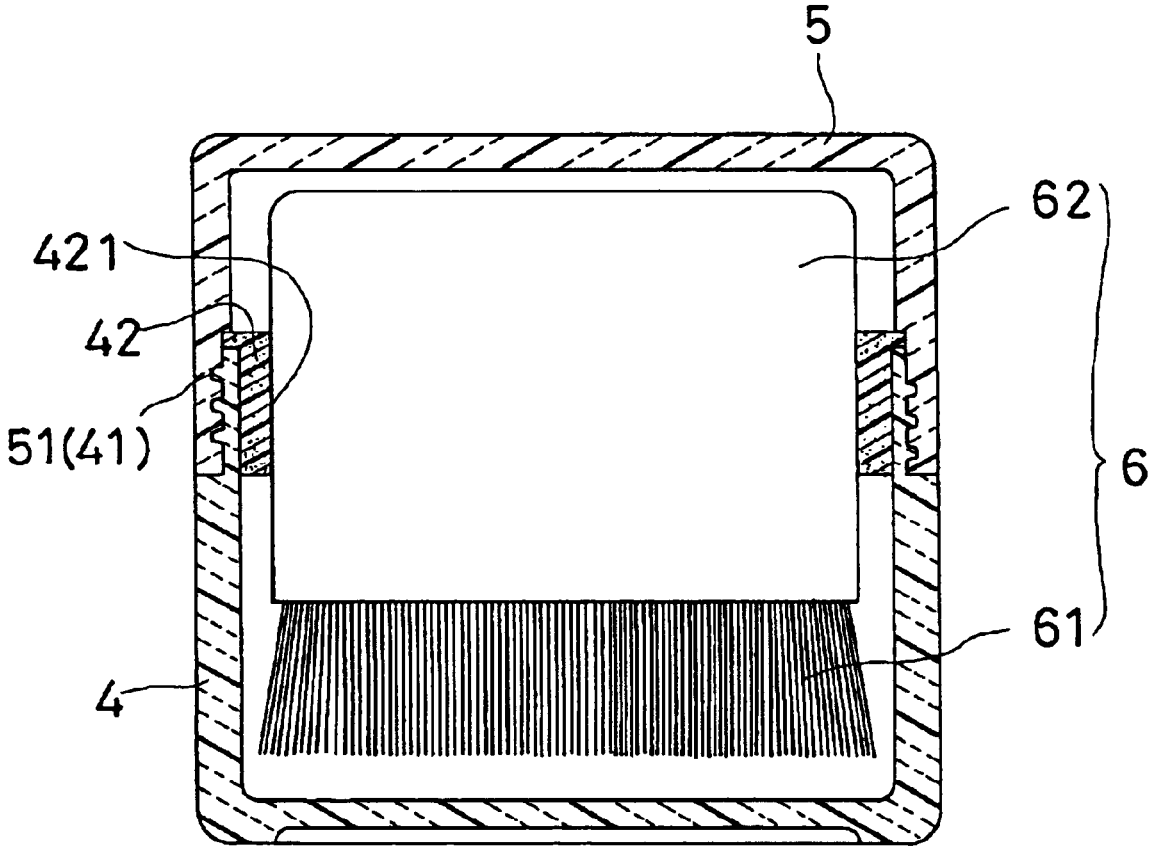
F I G. 6 (PRIOR ART)
FIG. 6 is a vertical section of the conventional cosmetic container.

When the covering part 3 is rotated in an undoing direction (counterclockwise, according to FIG. 3), the brush 2 will be stopped from rotating by the inner lid 12, and in turns, the covering part 3 will be upwards displaced relative to the brush 2, as shown in FIG. 3. The brush 2 can be taken out of the containing part 1 by means of lifting the covering part 1 as soon as the first connecting portion 31 separates from the containing part 1, as shown in FIG. 4, and the upwards-facing annular side 320 of the step-shaped connecting portion 32 will come into contact with a lower side of the detained block 24 at the same time to make the brush 2 more stably held on the covering part 3.

In addition, referring to FIGS. 1 and 3, the upwards-facing annular side 320 of the step-shaped connecting portion 32, and the lower side of the detained block 24 respectively have ratchet teeth 323, and 241 thereon; thus, the brush 2 will be still more firmly held on the covering part 3 owing to engagement of the ratchet teeth 323 with the ratchet teeth 241 after one screws the covering part 3 off the containing part 1.

From the above description, it can be easily understood that the cosmetic container of the present invention has advantages as followings:

1. One can use the brush 2 directly as soon as she separates the covering part 3 from the containing part 1. Therefore, the cosmetic container is more convenient to use as compared with the conventional one.
2. When the covering part 3 is secured to the containing part 1, the brush 2 is stably held in position, and the stopping rim 222 firmly pressed against the inner lid 12. Therefore, cosmetic in the containing part 1 will be prevented from passing into the covering part 3 to cause inconvenience in case the cosmetic is in the form of powder.
3. When one wants to close the cosmetic container, the stopping rim 222 will be first pressed against the inner lid 12. Therefore, the covering part 3 can be screwed onto the containing part 1 with more easiness.

What is claimed is:

1. A cosmetic container, comprising a containing part having an opening and an outer threaded portion on an upper end;

an inner lid securely disposed over the opening of the containing part; the inner lid having a noncircular hole on an upper portion thereof;

a covering part for covering the containing part with; the covering part having first threaded connecting portion on a lower portion of an inner side, and a second connecting portion above the first connecting portion on an inner side; the second connecting portion being formed with a step shape so as to have an upper section, a lower section having a smaller diameter than the upper section, and an upwards-facing annular side between the upper and the lower sections; the lower section of the step-shaped connecting portion being formed with screw threads;

a brush having a brush portion, and a threaded extension portion on top of the brush portion; the threaded extension portion being formed with a stopping rim around a lower end thereof; the threaded extension portion being screwed into the threaded lower section of the step-shaped connecting portion of the covering part;

a detained block secured to an upper end of the threaded extension portion of the brush, and received in the upper section of the step-shaped connecting portion so as to prevent the brush from separating from the covering part by means of coming into contact with the upwards-facing annular side of the step-shaped connecting portion of the covering part;

whereby the cosmetic container can be closed by means of screwing the first threaded connecting portion of the covering part onto the containing part with the brush portion being held in the non-circular hole of the inner lid, and with the stopping rim being pressed against an upper side of the inner lid.

2. The cosmetic container as claimed in claim 1, wherein both the upwards-facing annular side of the covering part and the lower side of the detained block have ratchet teeth thereon.

3. The cosmetic container as claimed in claim 1, wherein a plurality of threaded fixing element are used for securing the detained block to the top of the extension portion of the brush.

4. The cosmetic container as claimed in claim 1, wherein the covering part is formed with an annular holding portion on an upper end while a cap is held in, and securely connected with the annular holding portion.

5. The cosmetic container as claimed in claim 4, wherein the annular holding portion is formed with an annular trench on an inner side while the cap is formed with an annular protrusion, which is fitted in the annular trench.

* * * * *